US007247416B2

(12) United States Patent
Hsieh et al.

(10) Patent No.: US 7,247,416 B2
(45) Date of Patent: Jul. 24, 2007

(54) TONER PROCESSES AND COMPOSITIONS THEREOF

(75) Inventors: Bing B Hsieh, Webster, NY (US); Richard J. Thompson, Ohiopyle, PA (US)

(73) Assignee: Nu-kote International, Inc., Franklin, TN (US)

( * ) Notice: Subject to any disclaimer, the term of this patent is extended or adjusted under 35 U.S.C. 154(b) by 131 days.

(21) Appl. No.: 10/963,088

(22) Filed: Oct. 12, 2004

(65) Prior Publication Data

US 2006/0078814 A1 Apr. 13, 2006

(51) Int. Cl.
*G03G 5/00* (2006.01)

(52) U.S. Cl. ..... 430/137.19; 430/137.1; 430/137.18; 430/110.1

(58) Field of Classification Search ..... 430/137.19, 430/137.1, 110.1, 137.18
See application file for complete search history.

(56) References Cited

U.S. PATENT DOCUMENTS 4,833,060 A 5/1989 Nair et al.
4,965,131 A 10/1990 Nair et al.
5,049,469 A 9/1991 Pierce et al.
5,133,992 A 7/1992 Nair et al.
5,262,269 A * 11/1993 Nair et al. ..... 430/137.17
5,591,552 A 1/1997 Ciccarelli et al.
5,667,929 A 9/1997 Ciccarelli et al.
6,156,473 A 12/2000 Tyagi et al.
6,294,595 B1 9/2001 Tyagi et al.
6,380,297 B1 4/2002 Zion et al.
6,395,445 B1 * 5/2002 Toth et al. ..... 430/137.14

* cited by examiner

*Primary Examiner*—Mark A. Chapman
(74) *Attorney, Agent, or Firm*—Fay Sharpe LLP

(57) ABSTRACT

The invention relates to color toner compositions prepared from a process for the preparation of a dry toner powder from an aqueous pigment concentrate dispersion comprising: blending at least an aqueous-based pigment concentrate dispersion and a resin to produce a paste; charging the paste to an extruder to generate an extruded pigment/resin mixture; dispersing the extruded pigment/resin mixture in a low boiling organic medium to create an organic phase; dispersing the organic phase in an aqueous phase containing a particulate stabilizer and mixing the organic phase and the aqueous phase at elevated temperature and under shear force to form toner particles of a controlled size and shape; removing the organic solvent and particulate stabilizer from the formed particles; and washing, drying, and collecting the particles for use as a dry toner powder.

17 Claims, 2 Drawing Sheets
(2 of 2 Drawing Sheet(s) Filed in Color)

TONER PROCESSES AND COMPOSITIONS THEREOF

The invention relates to a color toner composition for use in developing an electrostatic image by electrophotographic, electrostatic recording and printing processes.

BACKGROUND

Present day toners are formulated from a range of potential components. Most toner compositions include at least a polymeric binder material and a colorant. Other commonly used components include black and colored magnetic oxides, charge control agents, internal additives to augment toner properties, such as aiding in deagglomeration and homogeneous distribution of the colorant in the toner composition, and external additives, to aid in the proper function of the toner. The components used in a particular toner formulation are dependent on the requirements of the machine in which the toner is ultimately intended to be used. For instance, the toner formulation must take into account such parameters as image quality, reliability, carrier life, toner shelf life, etc., all of which are intricately involved with the mechanical capability and design of the hardware of the machine. Often, there is more than one component of a toner formulation which performs to eradicate certain undesirable properties of the toner. These same components may however, also contribute to other problems, or the combination of two or more components which affect the same toner properties may result in over-correction of a problematic area in the toner performance. Therefore, the combination of components selected to comprise a given toner composition must be carefully balanced, taking into account the full range of toner performance parameters which may be affected by each component and the interaction of each component with every other component of the toner composition, and the machine and its various components and systems.

Given that each of the foregoing parameters will affect toner performance in some manner, it is unlikely that any one toner will achieve optimum performance in all areas. Therefore, toner producers determine which parameters are most critical to the performance of a toner for a given purpose and which may be compromised, and to what extent.

Toner performance is determined by the combination of components, and by the physical, electrical and chemical properties of each. Such properties include pigment dispersion, particle size, particle size distribution, particle shape, bulk density, mechanical strength, flow properties, triboelectric charge, resistivity, softening point, blocking temperature, melt viscosity, and dispersion. Each of these parameters must be considered for each component in determining what components to combine and how to combine the components to achieve a balanced toner which produces an image having those properties determined to be most important for a specific toner. This choice of components is further influenced by economic and environmental concerns.

The bulk polymeric material of the toner generally functions as the binder for the colorants included in the toner formulation, but also affects many of the other toner functions, such as charging, electrical resistivity, and mechanical integrity, to name a few. Therefore, often times a combination of resins is used to achieve the desired performance. Polymers generally used in toner may be linear, branched or cross linked, and are chosen for their various properties and the manner in which these properties are likely to affect toner performance. For example, certain binder polymer properties affect the thermal performance of the toner. These properties include such binder parameters as glass transition temperature, melt viscosity, blocking temperature, and thermal integrity. In the same manner, the mechanical properties of the binder polymer, including such parameters as impact strength, adhesive/cohesive strength, and surface energy will also affect toner performance. Electrical traits such as triboelectric charge function, resistivity, and dielectric constant, and other miscellaneous features, such as moisture resistivity, % volatility, molecular weight, colorlessness, and pigment compatibility, all have an affect on the ultimate performance level of the toner in which the binder is used.

Among the most popular resins from which the toner resin may be selected are: acrylic resins, epoxy resins, polyamide resins, polyester resins, polyethylene resins, polystyrene resins, styrene-acrylic copolymer resins, and styrene-butadiene resins. As with all toner components, choice of resin is generally determined by the machine parameters and toner performance qualities sought.

Dispersed in the binder resin are the colorants used in the toner formulation. In monocomponent toners, magnetic oxide pigments are used for the purpose of enhancing the magnetic attraction between the toner and the developer roll assembly. Carbon black has historically been the most popular colorant used in black toners, as it strongly influences the triboelectric charging capability of the toner. However, more recent toners employ charge control agents to achieve and control this toner feature, thus allowing the use of more easily dispersed black colorants. The black colorant may also affect the flow characteristics of the toner and, therefore, is sometimes added in incremental amounts to the toner surface.

The charge control agents are also critical in full color printing. The equipment of today allows the reproduction of beautiful, photographic-quality full color images. The printer/copier machines generally employ one or more cartridges which dispense color toner, as well as black toner. The basic color toners used are magenta, cyan and yellow, though any number of other color toners are available. Generally, however, variations in color and tone or shade are produced by the combined printed affect of a basic color set of toners.

Most toner formulations also include any one or more of a number of materials known commonly in the industry as additives. These are generally fine particles which are physically blended with the toner. They may be attached to the toner by electrical means, mechanical means, or by mere physical mixing. These additives may be added to influence flow control, charge control, cleaning, fixing, offset prevention, transfer, conductivity control, humidity sensitivity control, and carrier life stability. Common additive materials include silica, metal oxides, metal stearates, fluoropolymer powders, fine polymer powders, rare earth oxides, waxes, conductive particulates, magnetite, carbon, and titanates. Choice of additives is critical, however, given that many of the additives affect more than a single toner property.

Clearly, given the vast number of components available in the industry for use in toner compositions, and given the propensity for many of the components to enhance some properties and at the same time to deleteriously affect others, choice of components is not a routine matter.

In addition to the content of the toner, toner preparation must address the problem of generating content-uniform particles exhibiting small particle size, in the range of about 2 μm to about 15 μm, preferably from about 5 μm to about 8 μm, and exhibiting a narrow particle size distribution.

Shape of the particle can be equally important. The more uniform the shape and the smaller the particle size, the better the printed image. Several patents that disclose a means of controlling the shape and particle size of the toner particles include U.S. Pat. Nos. 4,833,060, 6,156,473, 6,294,595, and 6,380,297.

U.S. Pat. No. 4,833,060 discloses a process for producing powders of a controlled size and shape by dissolving a polymer in a solvent which is immiscible with water, forming a suspension of polymer/solvent droplets in the water, which contains a promoter and silica particles, and then removing the solvent from the polymer/solvent droplets, and drying and collecting the remaining polymer particles. These particles may then be used in toner. U.S. Pat. No. 5,049,469 also discloses a method of controlling particle size. In this patent, a latex copolymer is used as a stabilizer to control the size of the core in the shell-and-core toner particles disclosed. U.S. Pat. No. 6,294,595 teaches a process for preparing irregular-shaped toner particles by dispersing a polymer/organic solvent dispersion in an aqueous phase containing colloidal stabilizer particles with a positive charge and colloidal stabilizer particles with a negative charge. The use of only one or the other generates particles of a spherical nature, which this patent seeks to avoid. U.S. Pat. No. 6,380,297 achieves irregularly shaped particles by first creating spherical particles as taught in the processes just mentioned, and then surface-treating the particles with a surface-active agent to modify the particle shape.

Even if particle size and shape are controlled, uniformity and homogeneity of content remain a critical aspect of toner preparation. It is known, as was set forth earlier, to produce toner compositions which include pigment colorants. Such compositions may use carbon black. Other color toners may use color pigments commercially available from a number of sources. It is critical to the quality of the printed image, however, that the pigment or colorant used be homogeneously dispersed within the toner particles. This can be difficult to achieve given the propensity of pigment particulates to agglomerate, causing void areas in the toner particles which result in uneven color in the printed image. One means of dispersing a pigment in a toner composition is to use the pigment in the wet cake form. U.S. Pat. Nos. 5,667,929 and 5,591,552 disclose such a process for toner preparation. In these disclosures, pigment in the wet-cake form was added to a mixture of linear polyester and toluene to form a pre-dispersion. The water was flushed, or displaced, by a resin/toluene solution, and then the toluene removed to generate a crushed powder of resin and pigment. While this method does increase pigment dispersion to some degree, printed images using the toner nonetheless exhibit very average print quality.

Therefore, an aspect of concern, and the one of most importance to this invention, is that of pigment dispersion. In an optimum toner, each toner particle will be consistent with respect to performance, and will exhibit a uniform distribution of colorant, charge control agent, additives, etc. The degree to which this uniform dispersion is achieved affects the resulting triboelectric charge, color, yield, and finally the printed image.

One means to achieve homogeneous or uniform pigment dispersion is set forth in U.S. Ser. No. 10/878,860, filed Jun. 28, 2004, to our common assignee, the disclosure of which is incorporated herein by reference. In that disclosure, the pigment colorant is added to the toner composition in the form of an aqueous liquid pigment concentrate dispersion.

The current inventors have determined an alternative means by which to achieve uniform pigment dispersion within toner particles exhibiting volume average particle diameter of up to 15 μm. This is accomplished using an aqueous pigment pre-dispersion in combination with the processing steps set forth herein, to produce substantially spherical toner particles which have a uniform dispersion of particle components and are of small particle size and small particle size distribution, suitable for generating a printed image with enhanced brightness of colors, visual density and vividness of color. Each of the foregoing visible attributes is a direct result of the quality of the pigment dispersion incorporated into the toner.

SUMMARY OF THE INVENTION

It is therefore an object of the present invention to achieve a high quality pigment dispersion within toner particles which exhibit a particle size in the range of about 2 μm to about 15 μm.

It is another object of this invention to provide A process for the preparation of a dry toner powder from an aqueous pigment concentrate dispersion, the process comprising: blending at least an aqueous-based pigment concentrate dispersion and a resin to produce a paste; charging the paste to an extruder to generate an extruded pigment/resin mixture with a greater degree of dispersion than was present in the paste; dispersing the extruded pigment/resin mixture in a low boiling organic medium to create an organic phase; dispersing the organic phase in an aqueous phase containing a particulate stabilizer and optionally an interface promoter and mixing the organic phase and the aqueous phase at elevated temperature and under shear force to form toner particles of a controlled size and shape; removing the organic solvent, particulate stabilizer, and interface promoter, if used, from the formed particles; and washing, drying, and collecting the particles for use as a dry toner powder.

These and other objects of the invention will become known to the skilled artisan by reading and practicing the invention as described and set forth in the disclosure which follows.

BRIEF DESCRIPTION OF THE DRAWINGS

The patent or application file contains at least one drawing executed in color. Copies of this patent with color drawings will be provided by the Patent and Trademark Office upon request and payment of the necessary fee.

DETAILED DESCRIPTION OF THE INVENTION

Figure 1:
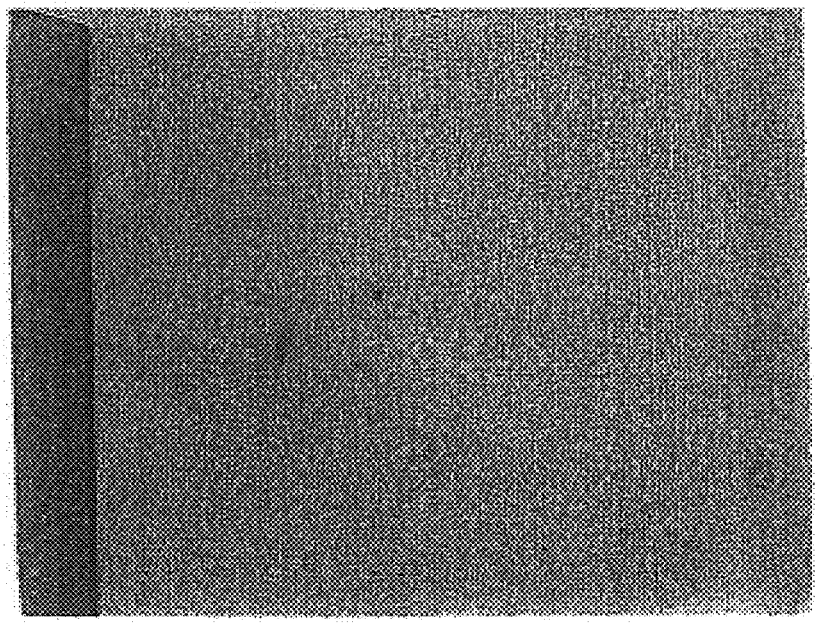
FIG. 1 is a photograph of a hot melt draw-down slide, viewed at 600× magnification, of a toner prepared using an aqueous pigment concentrate dispersion.

The present invention is related to a toner for use in the printing and recording of images by electrophotographic and electrostatic processes. More particularly, the invention relates to the use of specific toner components the use of which results in the production of clear, sharp images in bright, vivid color. In various embodiments of the subject invention, there are provided toners and processes for the production and use thereof wherein the toner composition comprises at least a binder resin and a colorant, and optionally additives, wherein the colorant is an aqueous pigment concentrate dispersion. The process disclosed involves mixing the toner components to generate molten toner, extruding the molten toner, and then dispersing the molten toner mixture in an organic solvent. This toner/solvent dispersion is then further dispersed in an aqueous medium containing stabilizers and optionally a promoter, and mixed under high shear and at elevated temperature, to achieve a suspension of toner particles which can then be recovered for use.

The toner composition includes a binder resin which may be selected from any of a number of known resin compound compositions. Suitable resin components include acrylates, epoxies, ethylene vinyl acetates, polyamides, polyolefins, polystyrenes, styrene acrylates, styrene methacrylates, styrene butadienes, cross linked styrene polymers, polyesters, cross linked polyester epoxies, polyurethanes, vinyl resins, including homopolymers or copolymers of two or more vinyl monomers; and polymeric esterification products of a dicarboxylic acid and a diol comprising diphenol. Vinyl monomers include styrene, p-chlorostyrene, unsaturated mono-olefins such as ethylene, propylene, buytlene, isobutylene, and the like; saturated mono-olefins such as vinyl acetate, vinyl propionate and vinyl butyrate and the like; vinyl esters such as esters of monocarboxylic acids, including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof; and the like. Examples of specific thermoplastic toner resins include styrene butadiene copolymers with a styrene content of from about 70 to about 95 weight percent. Additionally, cross linked resins, including polymers, copolymers, and homopolymers of the aforementioned styrene polymers may be selected.

As one suitable type of toner resin, there are selected the esterification products of a di-or poly-carboxylic acid and a diol comprising a diphenol. These resins are illustrated in U.S. Pat. No. 3,590,000, the disclosure of which is incorporated herein by reference. Other specific examples of toner resins include styrene/methacrylate copolymers, and styrene/butadiene copolymers; suspension polymerized styrene butadienes; polyester resins obtained from the reaction of bisphenol A and propylene oxide followed by the reaction of the resulting product with fumaric acid; and branched polyester resins resulting from the reaction of dimethylterphthalate, 1,3-butanediol, 1,2-propanediol, and pentaerythritol, styrene acrylates, and mixtures thereof. Also, waxes with a molecular weight of from about 1,000 to about 7,000, such as polyethylene, polypropylene, paraffin waxes, polyamide waxes and various natural waxes can be included in or on the toner compositions as internal lubricants or fuser roll release agents. Further, reactive extruded polyesters can be selected as the toner resin.

The resin or resins are included in the toner composition disclosed herein in an amount of from about 60% to about 90% of the toner composition. Preferably the resin component is included as from about 60% to about 80% of the total toner composition.

The resin particles may have a Tg of from about 50° C. to about 80° C. and an acid number below 30. The weight average molecular weight for the resin component should preferably be between about 10,000 and about 100,000.

Particularly well suited to practice of the invention are aqueous pigment concentrate dispersions, generally intended for use in liquid ink compositions or paints. Suitable dispersions may contain an aqueous medium into which the desired pigment has been dispersed. The dispersion may further include a surfactant component, or a polymeric pigment stabilizer, such as a water soluble acrylic copolymer. These additional components may be added to stabilize the pigment particles and to improve dispersibility of the pigment during processing. Other possible components of the pigment dispersion include compounds such as propylene glycol, which may be included to enhance the viscosity of the pigment dispersion and to aid in pigment wetting. Suitable aqueous pigment concentrate dispersions in accord with the foregoing include those available commercially from Sun Chemical, such as Aquatone® Dispersions, Flexiverse Dispersions, Sunsperse 6000 Dispersions and Moisture Tone® Dispersions, and those from Clariant known as Hostafine dispersions, among others. These dispersions generally include about 30 wt % to about 50 wt % pigment solids, and are included in the toner as from about 5 wt % to about 30 wt % of the toner composition.

Figure 2:
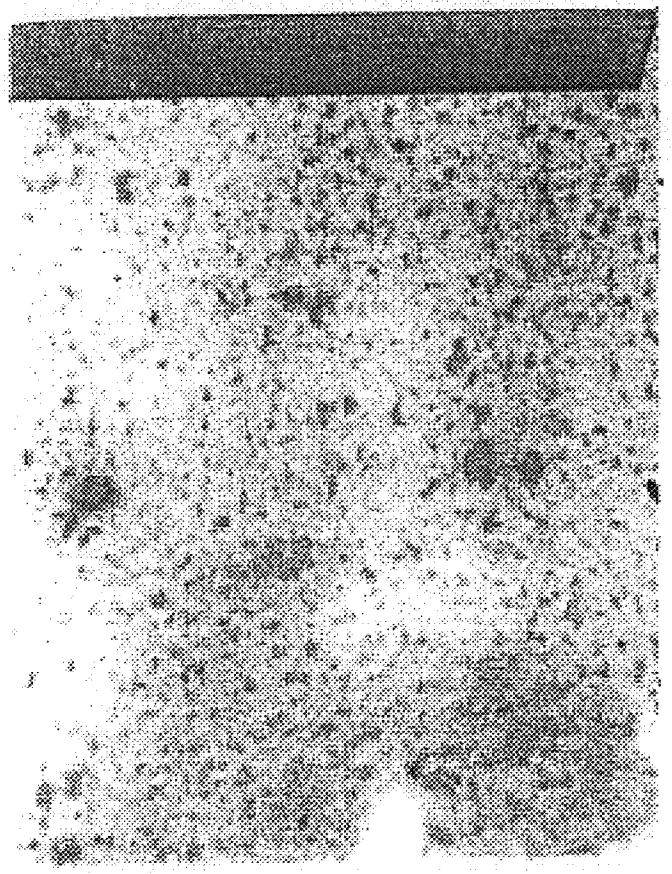
FIG. 2 is a photograph of a hot melt draw-down slide, viewed at 600× magnification, of a conventional toner prepared using dry pigment.

Toners prepared directly from dry pigment exhibit inferior pigment dispersion. FIG. 1 is a photograph of a toner prepared from an aqueous pigment concentrate dispersion. The photo is of a hot melt draw-down of the toner on a glass slide under an optical microscope at 600× magnification. As is shown, the pigment is well dispersed with substantially no agglomeration or void areas present. FIG. 2 is a photograph, prepared in accord with that shown in FIG. 1, of a toner sample prepared using dry pigment. The toner in FIG. 2 exhibits poor pigment dispersion, agglomeration and visible void areas. A comparison of these FIGS. 1 and 2 demonstrates clearly the advantage to be gained with regard to pigment dispersion by using an aqueous pigment concentrate dispersion as opposed to dry pigment.

In addition to the aqueous pigment concentrate dispersion, the toner composition may also include other colorants which may be any of the known pigments suitable for use in toner and developer compositions. Though pigments are generally a more preferred colorant because of their light fast properties and the water content, some dye colorants may also be used. These additional colorants may be added to achieve special colors and/or to increase color density. Specifically, the additional colorant should be suitable for use with the recited or suggested resin component, and also compatible with the remaining components of the toner composition. Examples of suitable pigments include carbon black like REGAL 330; magnetites, such as Mobay magnetites M08029, M08060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As color pigments, there can be selected cyan, magenta, yellow, red, green, brown, or blue pigments or mixtures thereof. Specific examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, CINQUASIA MAGENTA available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK, and cyan components may also be selected as pigments with the process of the present invention. These pigments may be used as dry powder or in the wet cake form. The additional pigment component should be included in the toner composition in an amount of from about 0 wt % to about 8 wt %, and preferably from about 0 wt % to about 5 wt % of the toner composition.

Charge control agents are added to a toner for the purpose of making the toner product either more electronegative or more electropositive. Whether the toner needs to be made more electronegative or more electropositive is determined by several factors. Some of these include the electronegativity of the remaining toner components as combined, i.e., different colorants and resins may impart different charge characteristics to the toner composition. Also, the carrier, if one will be used, must be considered, as many carrier materials impart a charge to the toner composition. Further, the machine in which the toner is used may impart some charge to the toner, as will the operation thereof. The purpose of the charge control agent component of the toner is to stabilize the toner with respect to electrical charge and thus avoid problems of print quality, color balance, and fogging, which are associated with too much or too little charge on the toner particles. Charge control agents may be selected from quaternary salts, metal and non-metal dyes, chromium, cobalt and zinc complexes, nigrosines, positive and negative colorless polymers, metal chelates, and quaternary amines, depending on the particular requirements of the complete toner composition.

Examples of suitable commercially available charge control agents include the following: S-34, S-40, E-82, E-81, E-84, E-87, E-88 and E-89, all manufactured by Orient Chemicals, and TRH, T-77, T-95, and TNS-2, all manufactured by Hodogaya Chemical Co. Charge control agents offered by BASF, Hoechst/Clariant, Zeneca and others may also be found to be suitable. These and other similar commercially available charge control agents may be selected. The charge control agent may be included in the toner composition as from about 0 wt % to about 10 wt % thereof, and preferably as about 0 wt % to about 5 wt % thereof.

The wax component to be used in the toner is preferably composed of at least one wax selected from the group consisting of polyolefin waxes, carnauba wax, candelilla wax, hydrogenated jojoba oil, rice wax, hydrogenated lanolin, meadowfoam oil, and derivatives thereof. Preferably, the polyolefin waxes include low molecular weight waxes such as polypropylenes and polyethylenes, such as EPOLENE N-15 commercially available from Eastman Chemical Products, Inc., and similar waxes. The commercially available polyethylenes may have a molecular weight of from about 1,000 g/mol to about 1,500 g/mol, while the commercially available polypropylenes utilized for the toner compositions of the present invention may have a molecular weight of from about 4,000 g/mol to about 7,000 g/mol.

Low molecular weight wax materials are present in the toner composition of the present invention in various amounts, however, generally these waxes are present in the toner composition in an amount of from about 0 wt % to about 15 wt %, and preferably in an amount up to about 10 wt %, based on the weight of the toner.

Useful plasticizers include both very low viscosity plasticizers and polymeric plasticizers that are liquid at room temperature. These low viscosity plasticizers can be used alone or as part of a mixture of low viscosity plasticizers. Typical examples of useful plasticizers include dimethylphthalate, dibutylphthalate, tributylphosphate, butylstearate, ethyleneglycolbutyletheracetate, diethyleneglycolethyletheracetate, and diethyleneglycolbutyletheracetate. The amount of plasticizer included in the toner is preferably up to about 5 wt %, based on the toner composition.

The toner of the present invention may further include external additives employed for the purpose of enhancing flowability of the toner product. The additive used may be a single component additive or may be a specific combination of additives, the combined use of which produces a special performance effect of the toner product. Additives may be selected from silicas, metal stearates, fluoropolymer powders, fine polymer powders, rare earth oxides, waxes, conductive particles, magnetite, carbon, and titanates, and other like compounds.

Post additive treatment agents, such as flowability enhancers of the type used in this toner product, result in deagglomeration of the toner particles in use, and enhanced stability during storage of the toner product. In selecting a flowability enhancing additive to be added to the toner product during a post-treatment step, it is important to consider these parameters: anti-caking; flowability; electrostatic charge stability; coefficient of friction; transfer efficiency; photoreceptor release properties; hydrophobicity; storage stability; and others. The indication of these characteristics generally requires inorganic compounds of fine particle size and high surface areas. These additives are often treated to render them hydrophobic in order to overcome the drawbacks associated with their conventionally hydrophillic nature.

For example, as the post additive to be employed in production of a toner in keeping with the present invention there may be used a hydrophobic silica fine powder in combination with a hydrophobic titanium oxide powder. Preferably, the titanium oxide powder is a silane treated powder. Other suitable external additives, or post additives, may include but are not limited to: aluminum oxide; zinc oxide; cerium oxide; strontium titanate; iron oxide; ferrite powder; calcium carbonate; copper oxide; barium sulfate; lithopone; metal salts of fatty acids; powdered fluoropolymers; polytetrafluoroethylene; polyethylene powder; carbon black; silicon carbide; silicon nitride; and powdered or fine particle polymers.

As an example of a toner formulation in accord with the claimed invention, provided hereinafter is processing information and toner formulations representative of the inventive toner compositions hereof.

For each of the following toner compositions, aqueous pigment concentrate dispersions commercially available from Sun Chemical were used. The dispersions are generally intended for use in liquid ink compositions and paints. Each dispersion included an aqueous base into which had been dispersed the desired pigment and a small amount of acrylic polymer, which functions as a pigment stabilizer. No surfactants are included in the dispersions used in the following examples, though other dispersions including surfactants would be expected to generate similar results. Each dispersion exhibited pigment concentration of about 30 wt % solids to about 50 wt % solids.

Toner compositions according to this invention are prepared by adding an aqueous pigment concentrate dispersion of the appropriate color to a high intensity mixer along with the remaining toner components, which may include resin, wax, charge control agent, additional pigment and plasticizer. Other optional components, such as additional pigment or dye, may also be added at this time. For purposes of these examples, the total pigment content should be in the range of about 5 wt % to about 15 wt %, the resin content should be in the range of about 60 wt % to about 90 wt %, the wax content should be in the range of about 1 wt % to about 15 wt %, the charge control agent content should be in the range of about 1 wt % to about 5 wt %, and the plasticizer content should be in the range of about 1 wt % to about 5 wt %. The components are blended in a blender such as the Henschel mixer for about 10 to about 30 minutes at a speed of about 1000 to about 3000 RPM to create a paste.

The resulting paste, including the pigment concentrate dispersion, resin, wax, charge control agent, plasticizer and about 12 wt % water, from the aqueous pigment concentrate dispersion, can then be transferred to a twin screw extruder and compounded at a temperature of about ambient to about 150° C., at about 400 RPM and at about 64% torque to drive off the water and to achieve a higher degree of pigment dispersion. The amount of water present in the extruder should be inversely proportional to the extrusion temperature. For example, water can be driven off substantially completely by operating the extrusion process at about 150° C. The extruded mixture, which contains the desired toner components, can then be cooled for use in the following toner particle formation process.

The cooled, extruded toner mixture can be mixed at a temperature of from about 20° C. to about 50° C. with a low boiling organic solvent, to give an organic phase mixture. The weight ratio of the extruded mixture to the organic solvent should be in the range of 10:90 to 60:40. The organic phase mixture may then be dispersed in an aqueous phase including a particulate stabilizer and optionally an interface promoter.

Suitable particulate stabilizers include but are not limited to the Ludox® colloidal silicas available from the DuPont Company and Nalcoag® colloidal silicas sold by Nalco. Examples include Ludox® CL silica, the particles of which are coated with alumina and are positively charged and Ludox® TM which is sodium stabilized and negatively charged. Properties of the colloidal silica products are described in the published product information brochure of the DuPont Company entitled "Ludox.RTM. colloidal silica—Properties, Uses, Storage and Handling". Also useful in the method of the invention are oppositely charged latex stabilizers of the types disclosed in U.S. Pat. Nos. 4,965,131 and 5,133,992, incorporated herein by reference.

The particle size and concentration of the colloidal stabilizers determines the size of the final toner particles. The smaller the size and/or the higher the concentration of the colloidal stabilizer particles, the smaller the size of the final toner particles. The particulate stabilizer is generally used in an amount ranging from about 1 to about 5 parts by weight per 100 parts of the final toner powder. The colloidal stabilizer particles generally should have dimensions of from about 1 nm to about 200 nm and, preferably, from about 5 nm to about 65 nm.

The interface promoter is water-soluble and can affect the hydrophilic/hydrophobic balance of the colloidal stabilizer in the aqueous solution. The promoter drives the solid dispersing agent, that is, the particulate stabilizer to the toner/solvent droplet-water interface. The interface promoter may be selected from the following, or from compounds of this type: sulfonated polystyrenes, alginates, carboxy methyl cellulose, tetramethyl ammonium hydroxide or chloride, diethylaminoethylmethacrylate, water soluble complex resinous amine condensation products such as the water soluble condensation products of dialkinol amine and adipic acid, especially, poly (adipic acid-co-metlhylaminoethanol), water soluble condensation products of ethylene oxide, urea and formaldehyde and polyethyleneimine. Also effective for this purpose are gelatin, casein, albumin, gluten and the like or nonionic materials such as methoxycellulose. The promoter is generally used in an amount of from about 0.2 to about 0.6 parts per 100 parts of aqueous solution. A promoter is not required when latex stabilizers are employed.

The dispersion process can be carried out using a mechanical shearing device such as a rotor-stator colloid mill, a microfluidizer, or a high pressure homogenizer. While any high shear type agitation device can be used in the process of this invention, it is preferred that the toner/solvent organic phase be introduced into the aqueous phase in a microfluidizer such as Model No. 110T produced by Microfluidics Manufacturing. In this device, a discontinuous phase of the toner/solvent droplets is formed in the continuous aqueous phase as the droplets of the toner/solvent organic phase are dispersed and reduced in size under high shear agitation. Each toner/solvent droplet is surrounded by the solid colloidal stabilizer particles. This limits and controls both the size and size distribution of the toner/solvent droplets. During mechanical shearing, the organic phase should be present as about 10 wt % to about 60 wt % of the total homogenized volume.

Once the shearing/mixing has been completed, and a homogeneous dispersion is achieved, the organic solvent can be removed from the dispersion by, for example, thermal or vacuum distillation, or any means known to the skilled artisan for such removal. In addition, the silica dispersing agent should be removed. This can be accomplished using an acid or an alkaline wash. A silica stabilizer can be removed by dissolving in HF or by adding an alkaline agent such as potassium or sodium hydroxide to the aqueous phase containing the toner particles to raise the pH to at least about 12 while stirring. After raising the pH and dissolving the silica, the toner particles can be recovered by filtration and washed with water or other agents to remove any undesirable impurities from the particle surfaces. Latex stabilizers, if used, need not be removed. They can remain as a skin on the surface of the particles and will not impair the use of the particles as electrostatographic toners. The toner particles may now be isolated by filtration, washed with water several times to remove residual acid or base, and then dried to give a fine, dry toner powder.

The mean particle size by volume of a toner in keeping with this processing may range from about 3 microns to about 15 microns, as measured on a Coulter Multisizer, depending upon the application and the requirements of the imaging machine in which the toner will be used. The resulting fine powder toner may be passed through an Air Classifier to selectively remove the ultra-fine particles, usually those of 5 microns or smaller, which may be detrimental to the xerographic process.

The toner powder thus produced was then post treated by blending the powder, in a Henschel High Intensity Blender, with a combination of post additives, in this instance hydrophobic silane treated silica fine powder and hydrophobic silane treated titanium oxide powder. Of course, a single post additive agent may also be used. The skilled artisan will be able to determine what post additive or post additive combination will best suit the toner product. Treatment with the post additives will produce a toner powder with optimum flow properties for use in the intended printer/copier machine.

EXAMPLE 1

In this Example 1, a cyan colored mixture is prepared in accord with the foregoing process parameters. The aqueous pigment concentrate dispersion used is BFD-1121 Pigment Blue, available commercially from Sun Chemical. The pigment dispersion is in liquid form and contains 30.8% pigment, 60% water and 9.2% acrylic polymer pigment stabilizer. The toner precursor mixture will contain about 9.5% by weight of this dispersion. The binder resin used in this toner precursor mixture may be a styrene butyl acrylate copolymer resin, and is added in an amount of 79% by weight of the composition. Additional dry pigment concentrate may also be added. Keystone Blue GN pigment, available commercially from Keystone Aniline Corp., may be added as 4.5 wt % of the formulation. The charge control agent, used as 2.0 wt % of the composition, comprises Bontron E-84, available commercially from Orient Chemicals. In addition to the foregoing, the composition will include 4 wt % of Ceralub P-40 polypropylene wax, available commercially from Shamrock Technologies, Inc., and 1 wt % Cabosil M-5 silica fine powder, available commercially from Cabot Corporation. In this example no plasticizer is used. The foregoing components are blended in a Henschel High Intensity Mixer for ten (10) minutes at a speed of 2,000 RPM. The resulting blend should be transferred to a Warner & Pfleiderer ZSK-30 twin screw extruder and compounded at 150° C. at 400 RPM and at about 64% torque. A cyan toner precursor mixture can now be extruded and collected.

EXAMPLE 2

A yellow colored mixture is prepared in accord with the processing described above in Example 1, using the following components: 11.5 wt % of a yellow aqueous pigment concentrate dispersion, YFD-4249 Pigment Yellow 17 dispersion, available commercially from Sun Chemical; 4.5 wt % dry pigment concentrate Clarient Permanent Yellow GG Pigment Yellow 17; 77 wt % styrene butyl acrylate copolymer resin; 4 wt % Ceralub P-40 polypropylene wax; 2 wt % zinc salicylic acid charge control agent; and 1 wt % Cabosil M-5 silica fine powder, available commercially from Cabot Corporation. This mixture is mixed in a Henschel High Intensity Mixer for ten (10) minutes at a speed of 2,000 RPM. The resulting blend is then transferred to a Warner & Pfleiderer ZSK-30 twin screw extruder and is compounded at 150° C. at 400 RPM and at about 64% torque to generate an extruded yellow toner precursor mixture.

EXAMPLE 3

In Example 3, a magenta toner precursor mixture is prepared in accord with the processing of Example 1, but differs in that the following are used: 21 wt % of magenta aqueous pigment concentrate QFD-1146 Pigment Red 122 dispersion from Sun Chemicals, comprising pigment, water and acrylic polymer pigment stabilizer; 4.0 wt % of dry pigment concentrate, Clarient HostaCopy M-501 Pigment Red 122; 69 wt % styrene butyl acrylate copolymer resin; 4.0 wt % Ceralub P-40 polypropylene wax; and 2.0 wt % zinc salicylic acid charge control agent. This mixture is mixed in a Henschel High Intensity Mixer for ten (10) minutes at a speed of 2,000 RPM. The resulting blend is then transferred to a Warner & Pfleiderer ZSK-30 twin screw extruder and is compounded at 150° C. at 400 RPM and at about 64% torque to generate an extruded magenta toner precursor mixture.

The foregoing mixtures can then be used to prepare toner powder in accord with the following processing.

EXAMPLE 4

The colored, extruded toner precursor mixtures of the foregoing Examples 1–3 are used below to illustrate use of the same in the toner particle formation process that is the subject hereof. In conducting the particle formation process, a reaction flask equipped with a mechanical stirrer is used. To this flask is added about 150 g of any one of the colored toner precursor mixtures prepared above, along with about 600 g of ethyl acetate. This mixture is stirred overnight and then poured into a homogenizing (5000 rpm) aqueous phase containing pH 4 buffer, at about 2240 g, and containing Ludox colloidal silica from DuPont (50.4 g) and 10% poly(adipic acid-co-methylaminoethanol) (10.8 g). Homogenization is continued at 5000 rpm for about 1 minute and then the mixture is transferred into a microfluidizer operating at 275 kPa. Upon exiting the microfluidizer, the solvent is removed by low-vacuum distillation at 40° C. to 50° C. The resulting mixture is cooled and the toner particles are allowed to settle, and the aqueous phase is then siphoned off. The toner particles that have been formed are then washed with 0.1 N KOH solution (2×1000 ml), deionized water (3×3000 ml) and then dried under vacuum. The toner particles that are collected exhibit a particle size in the range of about 6 μm to about 8 μm.

The advantages for a toner prepared from aqueous pigment concentrate dispersion over that prepared from a dry pigment include a higher degree of pigment dispersion, a higher color density at an equal pigment loading, a reduced pigment loading at a desired color density, narrower particle size distribution and charge distribution. A reduced pigment loading is advantageous in reducing the amount of pigment exposed on the surface of a toner particle and thus narrowing the charge distribution. A reduced pigment loading should reduce fine particles of less than 3 microns and thus narrow the particle size distribution. A higher degree of pigment dispersion becomes critical for the preparation of smaller size toner particles (5–8 microns) that are needed for the new generation of high resolution laser printers and copiers. The use of an aqueous pigment concentrate dispersion becomes the method of choice for achieving the smaller size toner particles that show high color density, narrow charge distribution and narrow particle size distribution.

The invention contemplated by this disclosure includes color toner formulations prepared using an aqueous, liquid state, pigment concentrate dispersion containing up to about 50% solids. The invention is shown to be well suited to the preparation of a full color set of toners, including magenta, cyan and yellow toners. It is to be understood that the inventive aspects of the formulation as presented herein are equally applicable to all color toner formulations, and it is intended that the invention should be construed in keeping with and afforded the full breadth of coverage of the appended claims.

Having thus described the invention, we claim:

1. A process for the preparation of a dry toner powder from an aqueous pigment concentrate dispersion, the process comprising:

a. blending at least an aqueous-based pigment concentrate dispersion and a resin to produce a paste;

b. charging the paste to an extruder and compounding the paste at a temperature of up to about 150° C. to generate an extruded pigment/resin mixture with a greater degree of dispersion than was present in the paste;

c. dispersing the extruded pigment/resin mixture in a low boiling organic medium to create an organic phase;

d. dispersing the organic phase in an aqueous phase containing a particulate stabilizer and optionally an interface promoter and mixing the organic phase and the aqueous phase at elevated temperature and under shear force to form toner particles of a controlled size and shape;

e. removing the organic solvent, particulate stabilizer, and interface promoter, if used, from the formed particles; and f. washing, drying, and collecting the particles for use as a dry toner powder.

2. The process of claim 1 wherein the aqueous pigment concentrate dispersion comprises water, pigment, a pigment stabilizer, and optionally a surfactant, and exhibits from about 30% to about 50% by weight pigment solids.

3. The process of claim 1 wherein the paste further comprises one or more toner components selected from the group consisting of a wax, a charge control agent, an additional colorant, and a plasticizer.

4. The process of claim 3 wherein the wax is a low molecular weight wax selected from the group consisting of polyolefin waxes, carnauba wax, candelilla wax, hydrogenated jojoba oil, rice wax, hydrogenated lanolin, meadowfoam oil, and derivatives thereof, and is used as up to 15 wt % of the paste.

5. The process of claim 3 wherein the charge control agent is selected from the group consisting of quaternary salts, metal and non-metal dyes, chromium, cobalt and zinc complexes, nigrosines, positive and negative colorless polymers, metal chelates, and quaternary amines, and is included as up to about 10 wt % of the paste.

6. The process of claim 3 wherein the additional colorant, present as up to 8 wt % of the paste, is a dry pigment.

7. The process of claim 1 wherein the extrusion process of step (b) drives off substantially all of the water from the aqueous pigment concentrate dispersion.

8. The process of claim 1 wherein the extruded pigment/resin mixture is mixed with the low boiling organic medium at a temperature of from about 20° C. to about 50° C. and at a weight ratio of extruded mixture to organic medium of from 10:90 to 60:40.

9. The process of claim 1 wherein the organic phase, present as from about 10% to about 60% of the total volume being mixed, is dispersed in the aqueous phase in a microfluidizer to generate content-uniform droplets of toner/organic medium, the size of which is reduced under high shear agitation.

10. The process of claim 1 wherein the particulate stabilizer of step (d) is particulate silica.

11. The process of claim 1 wherein the dry toner powder produced by the process exhibits a particle size of from about 5 μm to about 8 μm and is substantially spherical.

12. The process of claim 1 wherein the dry toner powder produced by the process is further combined with at least one external post-additive agent.

13. A dry toner powder comprising homogeneous toner powder particles containing at least a binder and a colorant, wherein the colorant is derived from an aqueous pigment concentrate dispersion, the aqueous solvent from which is removed during processing of the toner powder to generate dry toner powder particles exhibiting substantially uniform content and a particle size of from about 5 microns to about 8 microns.

14. The dry toner powder of claim 13 wherein the aqueous pigment concentrate dispersion comprises at least water, pigment, and a pigment stabilizer, and exhibits a pigment content of about 40% solids.

15. The dry toner powder of claim 13 wherein the dry toner powder is prepared from a mixture comprising about 9.5% aqueous pigment concentrate dispersion, about 79% binder, about 4% wax component, about 2% charge control agent, about 4.5% dry pigment colorant, and about 1% fine silica powder, based on the total weight of the mixture.

16. The dry toner powder of claim 13 wherein the toner powder particles are substantially spherical.

17. The dry toner powder of claim 13 wherein the toner powder particles exhibit a narrow size distribution.

* * * * *